US006544112B1

(12) United States Patent
Fuchs

(10) Patent No.: US 6,544,112 B1
(45) Date of Patent: Apr. 8, 2003

(54) BELT TRACKING ADJUSTMENT MEANS FOR BELT TYPE ABRADING MACHINE

(76) Inventor: Richard Fuchs, 17 Deerfield La., Simsbury, CT (US) 06070

( * ) Notice: Subject to any disclaimer, the term of this patent is extended or adjusted under 35 U.S.C. 154(b) by 0 days.

(21) Appl. No.: 10/053,134

(22) Filed: Jan. 17, 2002

(51) Int. Cl.[7] ..... B24B 21/00
(52) U.S. Cl. ..... 451/297; 451/311
(58) Field of Search ..... 451/297, 311, 451/296

(56) References Cited

U.S. PATENT DOCUMENTS

| | | | | |
|---|---|---|---|---|
| 3,497,336 | A | | 2/1970 | Buschman |
| 4,294,044 | A | | 10/1981 | Hansen |
| 4,603,510 | A | * | 8/1986 | Rasmussen |
| 4,742,649 | A | * | 5/1988 | Fuchs |
| D305,029 | S | | 12/1989 | Fuchs |
| 4,896,462 | A | * | 1/1990 | Farmerie |
| 5,036,626 | A | | 8/1991 | Fuchs |

* cited by examiner

*Primary Examiner*—Eileen P. Morgan
(74) *Attorney, Agent, or Firm*—McCormick, Paulding & Huber LLP

(57) ABSTRACT

A belt tracking mechanism for a belt using machine having a frame, a drive pulley, an idler pulley and a belt trained over the pulleys includes a support member for supporting the idler pulley for rotation about an axis fixed relative to the support member. A mounting stud attached to the support member parallel to the idler pulley axis and threadably engaged with an adjustment knob connects the support member to the frame, the stud being loosely received in an opening in the frame and the knob loosely engaging the frame around the opening on a side of the frame facing away from the support member. A spring biases the support member in a belt tightening direction about the axis of the mounting stud, and the forces imposed on the support member by the belt and spring and mounting stud hold a bend line of the support member, which extends transversly of the support member against the frame. The looseness between the stud and the frame allows movement of the support member about the bend line to adjust the inclination of the idler pulley axis relative to the drive pulley axis to achieve proper tracking of the belt over the pulleys.

12 Claims, 3 Drawing Sheets

BELT TRACKING ADJUSTMENT MEANS FOR BELT TYPE ABRADING MACHINE

FIELD OF THE INVENTION

The present invention is generally directed to a belt type abrading machine such as a grinder or sander, or other belt using machine; and, is more particularly directed to a belt tracking mechanism for such a machine.

BACKGROUND OF THE INVENTION

Belt grinders or sanders of the general type having a belt drive pulley, at least one driven or idler pulley and an endless abrasive or other belt trained over the pulleys are old in the art, as evidenced by U.S. Pat. Nos. 3,497,336 and 4,294,044. During the operation of such a machine, it is desirable that the belt track properly over the pulleys, that is, that it maintain a position substantially laterally centered on the belt engaging faces of the pulleys. However, slight alignment errors in the relation of the axes of the pulleys to one another or slight variations in the lengths of the edges of the belt can cause the belt to move off track by shifting laterally to one side or the other from the desired centered position. In some instances, the belt may run completely off of the pulleys or rub against a wall or other structure located adjacent one or both of the pulleys or the belt.

To allow for correction of the running path of the belt, it has been common practice in belt abrading machines to provide a means for adjusting the inclination of an idler pulley axis relative to the drive pulley axis. Such adjustment means have however tended to pose various problems of their own, including being of a complex, expensive construction and being difficult to operate or fine tune.

It is an object of the present invention to provide a simplified, inexpensive, and easy to operate adjustable belt tracking mechanism for belt type abrading machines and the like. The invention provides a support member for the idler pulley having a threaded stud attached thereto and an adjustment knob threadably engaged with the stud such that the stud and adjustment knob serve to both pivotally connect the support member to the machine frame for movement about an axis generally parallel to the pulley axes, to allow for variance in the spacing between the axes of the idler and drive pulleys, and to also connect the support member to the frame in such a way that the support member may pivot relative to the frame about an axis or hinge line located in a plane perpendicular to the idler pulley axis to change the inclination of the idler pulley axis relative to the drive pulley axis, with rotation of the adjustment knob effecting such change in inclination.

SUMMARY OF THE INVENTION

The present invention resides in a belt type abrading machine having a frame, a drive pulley mounted on the frame for rotation about an axis fixed relative to the frame, an idler pulley, an endless belt abrasive or otherwise trained over the drive pulley and the idler pulley, and a novel means for connecting the idler pulley to the frame whereby the spacing between the axes of the two pulleys may be varied, the idler pulley axis being urged away from the drive pulley axis by a spring to tension the belt, in conjunction with the a tracking adjustment whereby the inclination of the idler pulley axis relative to the drive pulley axis may be adjusted to bring the belt to a condition of tracking properly over the two pulleys while the machine is running. The frame of the machine can be oriented such that the drive and idler pulleys are aligned either in a horizontal or vertical configuration.

The invention more particularly resides in an idler pulley support member being provided for supporting the idler pulley for rotation about an axis fixed relative to the support member. The idler pulley support member is in turn itself connected to the frame by a threaded stud and an adjustment knob threadably coupled with the stud. The adjustment knob is rotatably engaged with an aperture in the frame such that the support member is supported for movement relative to the frame about the axis of the stud which extends generally parallel to the pulley axes to allow the idler pulley, as a result of such rotation of the support member relative to the frame and about the axis of the threaded stud, to be moved toward or away from the drive pulley to loosen or tighten the belt with respect to the pulleys, the support member being further biased by a spring in the belt tightening direction so that the belt will normally be tensioned. The adjustment knob and threaded stud, together facilitate an angular adjustment of the support member relative to the frame about a tracking adjustment axis located in a plane generally perpendicular to the idler pulley axis. The support member and the frame engage one another along the tracking adjustment axis and are held in such engagement by the moments exerted on the support member by the belt and the spring.

DETAILED DESCRIPTION OF THE PREFERRED EMBODIMENTS

Figure 1:
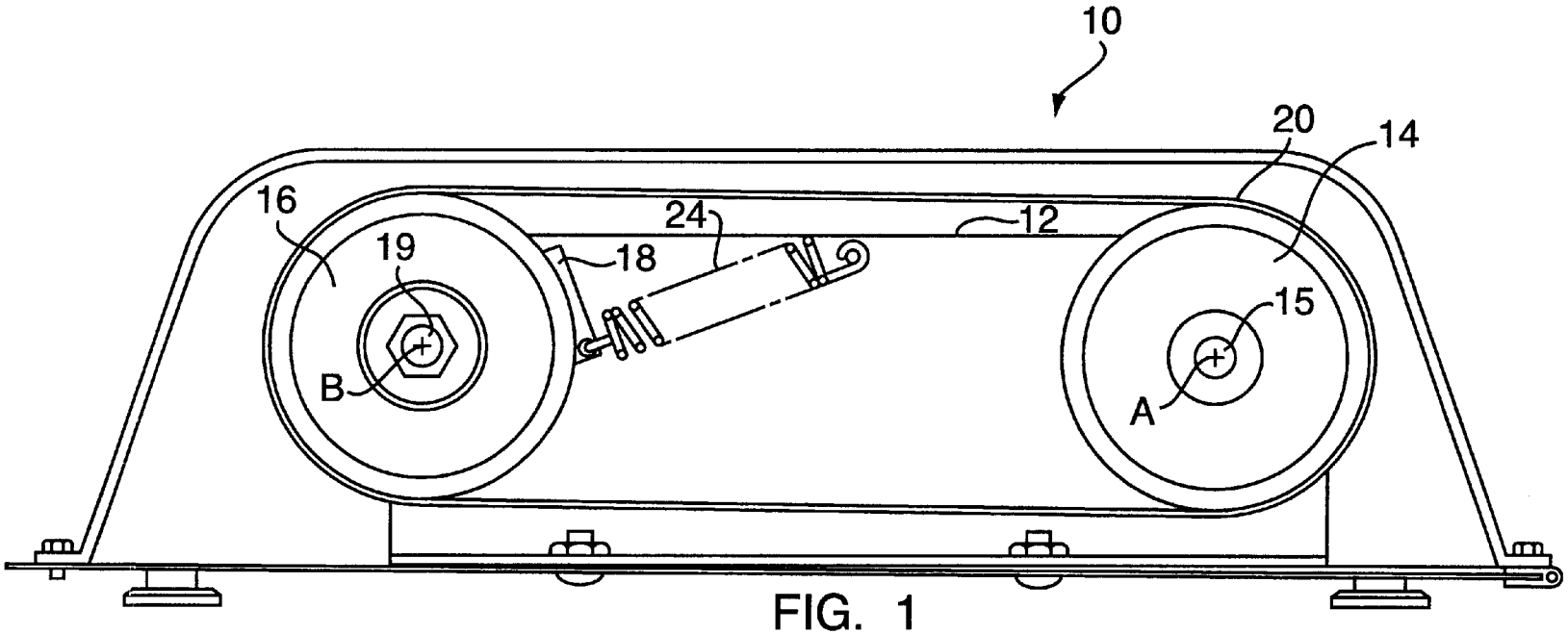
FIG. 1 is a side elevational view of a belt type abrading machine embodying the present invention.
Figure 2:
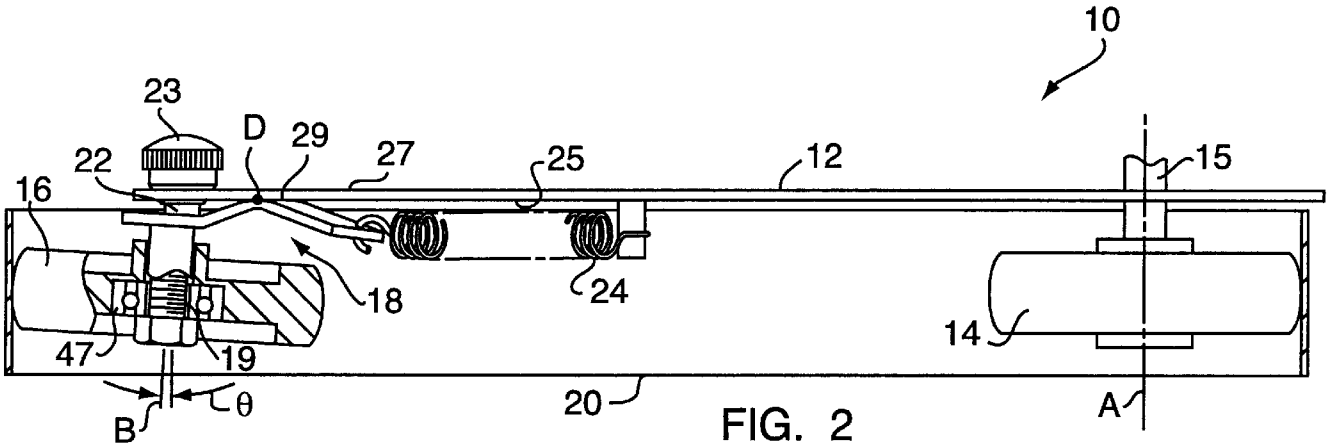
FIG. 2 is top view of the machine of FIG. 1 with its cover removed.
Figure 3:
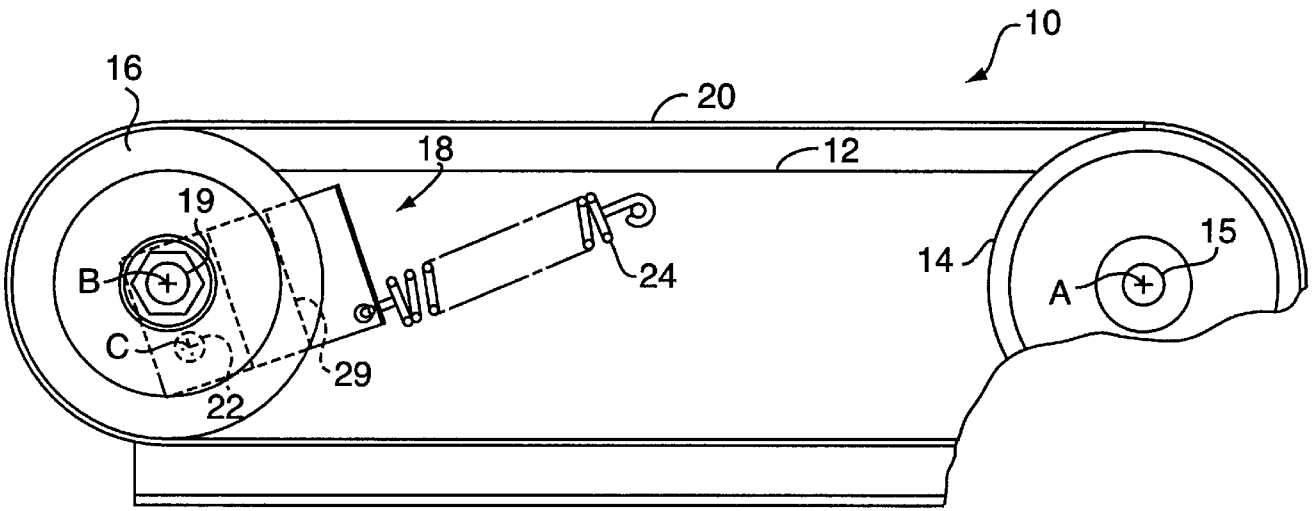
FIG. 3 is a partial side view of the machine of FIG. 1.

Turning to the drawings, FIGS. 1–3 illustrate a belt type abrading machine, indicated generally at 10, embodying the present invention. The machine 10 comprises a frame 12 and a drive pulley 14 supported for rotation about an axis A fixed relative to the frame. The drive pulley is driven by a suitable power source including an electric motor and the like. The nature of the power source may vary, but in the illustrated case it is an electric motor (not shown), the drive pulley being fixed to the output shaft 15 of the motor. The machine 10 further includes an idler pulley 16 supported by an idler pulley support member 18 for rotation about an axis B fixed relative to the member 19 and substantially parallel to the drive pulley axis A. An endless abrasive faced belt 20 or the like, is trained over drive pulley 14 and the idler pulley 16.

Figure 4:
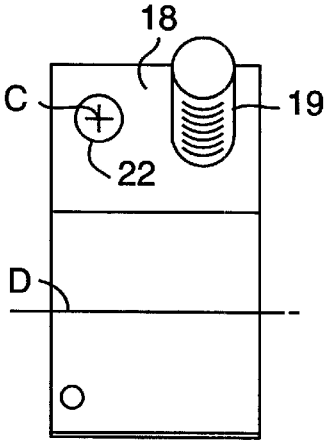
FIGS. 4 and 5 are front and side views respectively of the support member of the embodiment of the present invention shown in FIGS. 1, 2 and 3.
Figure 6:
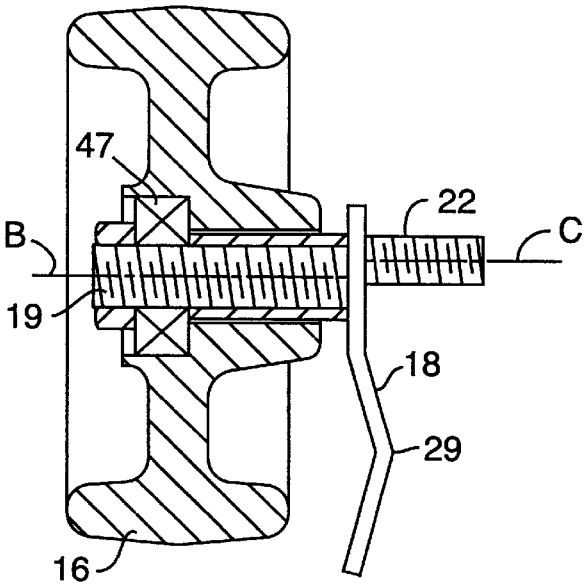
FIG. 6 is side view, partially in section of the support member and idler pulley of the embodiment of the present invention shown in FIGS. 1–3.

The support member 18, as seen in FIGS. 3 and 4, is of generally rectangular shape. The idler pulley 16 may be supported from it in various different ways without departing from the invention, but in the illustrated case, as seen best in FIGS. 2 and 6, stud 19 is fixed to the member 18, and rotatably supports the idler pulley 16 for rotation about the axis B of the stud through the intermediary of bearing 47 or otherwise. The support member 18 is positioned inside of an area defined by the frame 12 and the two runs of the belt 20 to make the machine 10 compact.

Figure 7:
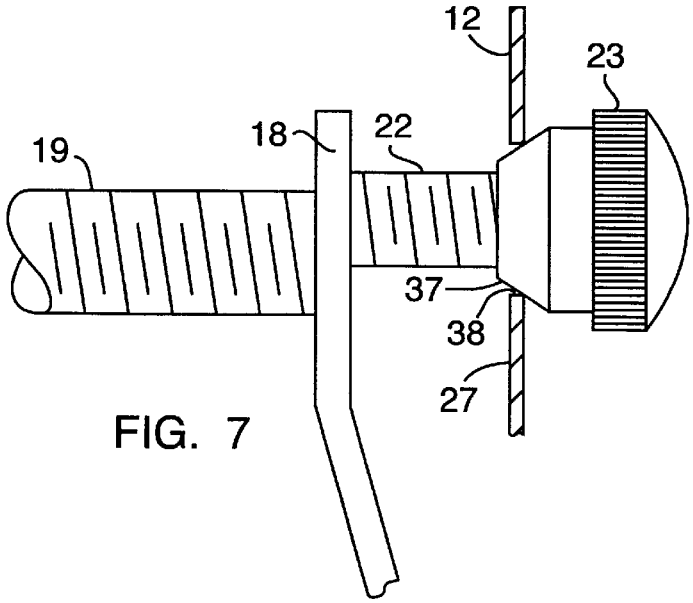
FIG. 7 is a partial sectional view of the frame and adjustment knob of the embodiment of the present invention as shown in FIGS. 1, 2 and 3.

The frame 12, as seen in FIG. 2, has a side wall portion 27 located to one side of the idler pulley 16 and located in a plane generally perpendicular to the idler pulley axis B. The idler pulley support member 18 is located between the side wall portion 27 and the idler pulley 16 and is itself carried by the wall portion 27 of the frame 12 via threaded stud 22 attached to support member 18. As shown in FIG. 7, stud 22 is threadably engaged with adjustment knob 23 which has an angular shoulder portion 37 rotatably disposed in an aperture 38 in side wall portion 27 of frame 12. The stud 22 is oriented so that its longitudinal axis C is generally parallel to the axis B of the idler pulley 16. In combination, the adjustment knob 23 rotatably disposed in sidewall 27 and threadably engaged with stud 22 support the support member 18 for movement relative to the frame 12 about the axis C. The axis B is spaced horizontally and parallel to axis C and therefore such pivotal movement of the support member 18 varies the spacing between the pulley axes A and B. A spring 24 is connected between the frame 12 and member 18, as shown in FIGS. 1, 2 and 3, and biases support member 18 in a counterclockwise or belt tightening direction about the axis C.

As best shown in FIG. 2, when the abrasive belt 20 is trained over the pulleys 14 and 16, the moment exerted on support member 18 by belt 20 and by spring 24 cause an apex portion of bend 29 in support member 18 to be held in engagement with surface 25 of the frame 12. At bend 29, the surface 25 being substantially flat and at right angles to the axis B. The bend 29 of support member 18 at D therefore defines a line of engagement or hinge at axis D about which the support member 18 is pivotal as a hinge relative to the frame 12 to vary the inclination of the idler pulley axis B relative to the drive pulley axis A, shown as angle theta, θ, on FIG. 2.

A second function of the stud 22 and adjustment knob 23, is to adjustably limit the movement of the support member 18 about the axis D, that is, to adjust the inclination of the idler pulley axis B relative to the drive pulley axis A, about the axis D. Adjustment of the alignment of the idler pulley axis B relative to the axis of the drive pulley is shown as angle θ on FIG. 2. The exact structure of the stud 22 and its cooperation with knob 23, support member 18 and frame 12 to provide this adjustable limiting function may vary, but in the illustrated case stud 22 is attached to support member 18 at one end and threadably receives adjustment knob 23 at a second end thereof. The adjustment knob 23 has a conical shoulder portion 37 rotatably disposed in an aperture 38 in the sidewall 27 of frame 12. By turning the adjustment knob 23 in one direction or the other on the stud 22, the support member 18 may be moved about the axis D relative to the frame 12 to vary the inclination of the axis B relative to the axis A. As shown in FIG. 7, the conical shoulder portion 37 of adjustment knob 23 is disposed in the aperture 38 such that the shoulder 37 facilitates adjustment of the inclination of axis B relative to axis A. Further, aperture 38 in frame 12 is sized to receive the conical shoulder 37 of knob 23 such that the threads of stud 22 and adjustment knob 23 are spaced apart from the aperture 38 providing means for smooth and stepless tracking adjustments of the belt 20 on pulleys 14 and 16.

If the edges of the belt are of equal length and if the axes of rotation of the drive pulley 14 and of the idler pulley 16 are truly parallel to one another, and if there are no other alignment errors in the machine, the belt 20 should maintain a position substantially laterally centered with respect to the belt engaging faces of the two pulleys while the machine is running. However, this will often not be the case when a new belt is first put onto the machine or is reversed. Instead a new belt may tend to move off track by shifting laterally to one side or the other of the desired centered position when the machine is put into operation. Also, after the machine has been run for some time stretching of the belt or other changes may occur which causes the belt to tend to shift laterally.

Figure 5:
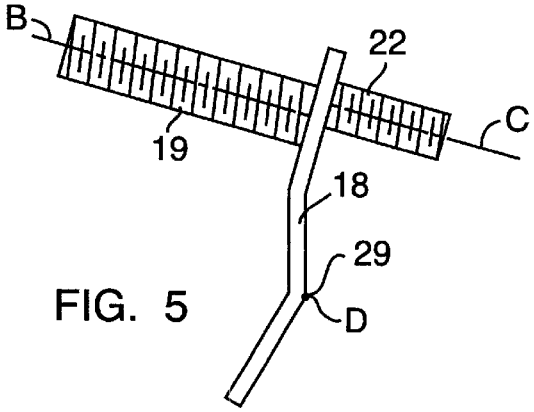

The present invention allows for simple and easy correction of this belt shifting problem via adjustment knob 23. That is, the knob 23 threadably engaged with stud 22 is manually operable so that by turning it in one direction or the other on stud 22, the idler pulley axis B is tilted in one direction or the other relative to the axis A of the drive pulley. Further, such adjustment can be made slowly as the machine operates to allow the operator to observe the effect of the adjustment and to easily achieve the degree of adjustment necessary to bring the belt into the desired location. The adjustment knob 23, as mentioned, adjustably limits the positioning of the support member 18 relative to the frame 12 about the axis D and it also permits the member 18 to rotate about the axis C to change the spacing between the two pulleys to accommodate the slight differences or changes in the length of the belt and to maintain tension in the belt through the spring 24. Referring again to FIG. 2, as support member 18 rotates about the axis C, the bend 29, of support member 18, which defines the axis D, slides over the flat face 25 of frame 12 so as not to interfere with or prevent such rotation. Support member 18 is preferably made as an essentially flat plate having a pair of opposing parallel bends therein perpendicular to the length thereof as shown best in FIGS. 4, 5 and 6.

What is claimed:

1. A belt tracking adjustment means for a belt using machine having a frame, a drive pulley with a rotational axis fixed relative to the frame, at least one idler pulley with a rotational axis generally parallel to the drive pulley rotational axis, and an endless belt trained over said pulleys, said tracking adjustment means comprising:

a support member having a longitudinal axis and carrying said idler pulley for rotation about the idler pulley axis, with the idler pulley axis being fixed relative to said support member;

a mounting stud fixed to the support member and having a longitudinal axis parallel to and spaced from the idler pulley axis, which mounting stud extends loosely through an opening in the frame so that the support member is movable relative to said frame about said longitudinal mounting stud axis, with rotation of said support member in one direction about the longitudinal mounting stud axis tightening the tension created by the pulleys in the belt and rotation of the support member in the opposite direction about the longitudinal mounting stud axis loosening the tension created by the pulleys in the belt;

a spring connected between said support member and said frame biasing said support member in the belt tension tightening direction about said mounting stud axis;

said frame having a substantially flat face opposite said support member located in a plane generally at a right angle to said longitudinal mounting stud axis, and said support member having two opposite ends and being bent to define a bend line located between the two opposite ends and extending substantially at a right angle to the longitudinal axis of the support member, along which bend line the support member is held in engagement with said flat frame face by the forces exerted on said support member by said spring and belt and mounting stud;

said support member being movable about said bend line relative to said frame to vary the inclination of said idler pulley rotational axis relative to the rotational axis of said drive pulley; and means co-operable with the mounting stud and frame for adjustably limiting the position of said support member relative to said frame and about said bend line in the direction toward which said support member is biased about said bend line by the forces imposed on said member by said belt and said spring and said mounting stud;

said support member being positioned entirely within the area surrounded by said endless belt as seen looking generally parallel to said rotational axis of said drive pulley.

2. A belt tracking adjustment means as defined in claim 1 further characterized by said support member being made from sheet material and having one end portion generally parallel to said flat frame face, an intermediate portion extending inclinedly from said one end portion to said bend line, and a second end portion extending from said bend line away from said flat frame face, with said mounting stud being fixed to said one end portion of the support member.

3. A belt tracking adjustment means as defined in claim 2 wherein said spring is connected to said second end portion of said mounting member.

4. A belt tracking adjustment means as defined in claim 1 wherein:

said opening through which the mounting stud loosely extends is located in said flat face of the frame, and said means for adjustably limiting the position of the support member is an adjustment knob rotatably engaged with the frame on a side of the frame opposite to said flat face and threadably connected to said mounting stud such that rotation of said adjustment knob pivots the support member about said bend line and thereby adjusts the angle of said idler pulley axis relative to the axis of said drive pulley.

5. A belt tracking adjustment means for a belt using machine having a frame, a drive pulley with a rotational axis fixed relative to the frame, at least one idler pulley with a rotational axis generally parallel to the drive pulley rotational axis, and an endless belt trained over said pulleys, said tracking adjustment means comprising:

a support member having a longitudinal axis and carrying said idler pulley for rotation about an axis fixed to said support member;

a mounting stud fixed to the support member and having a longitudinal axis parallel to and spaced from the idler pulley axis, which mounting stud extends loosely through an opening in the frame so that the support member is movable relative to said frame about said longitudinal stud axis, with rotation of said support member in one direction about the longitudinal mounting stud axis tightening the tension created by the pulleys in the belt and rotation of said support member in the opposite direction about the longitudinal mounting stud axis loosening the tension created by the pulleys in the belt;

a spring connected between said support member and said frame biasing said support member in the belt tension tightening direction about said mounting stud axis;

said frame having a substantially flat face opposite said support member located in a plane generally at a right angle to said longitudinal mounting stud axis;

said support member having a bend line oriented generally at a right angle to the longitudinal axis of the support member, which bend line is held in engagement with said flat frame face by the forces exerted on said support member by said spring and belt and mounting stud;

said support member being pivoted about said bend line relative to said frame to vary the inclination of said idler pulley rotational axis relative to the rotational axis of said drive pulley; and means co-operable with the mounting stud and the frame for adjustably limiting the position of said support member relative to said frame and about said bend line in the direction toward which said member is biased about said bend line by the forces imposed on said member by said belt and said spring and said mounting stud;

said spring being connected to a first point on said frame and to a second point on said support member, which second point is located on a second portion of said support member which is on a side of said bend line opposite to that of a first portion of said support member which carries the mounting stud.

6. A belt tracking adjustment means for a belt using machine as defined in claim 5 wherein said support member is arranged so that said second portion of said support member is closer to the drive pulley than is said first portion of the support member.

7. A belt tracking adjustment means for a belt using machine as defined in claim 5 wherein said frame has a wall generally at a right angle to said idler pulley rotational axis located to one side of said idler pulley and having a flat face facing said idler pulley, which flat face is engaged by said bend line of the support member, said support member being located between said frame wall and said idler pulley, said idler pulley being connected to said support member by means of a shaft fixed to said support member and extending from said support member in the direction away from said frame wall, said idler pulley being rotatably supported on said shaft.

8. A belt tracking adjustment means as defined in claim 7 wherein said support member is made of sheet material and has a pair of opposing bends therein extending along lines generally at right angles to the longitudinal axis of the support member with one of said bends defining said bend line which engages said flat face of said frame.

9. A belt tracking adjustment means as defined in claim 8 wherein said means for adjustably limiting the position of said support member relative to said frame and about said bend line includes, said opening through which the mounting stud loosely extends being located on said flat face of said frame opposite said support member; and an adjustment knob rotatably engaged with the frame of the opening and threadably connected to said stud on the side of the frame wall opposite to the flat face so that rotation of said adjustment knob pivots said support member about the bend line and thereby adjusts the angle of said idler pulley axis relative to the axis of said drive pulley.

10. A belt tracking adjustment means as defined in claim 6 wherein said support member is positioned inside of the area surrounded by said endless belt as seen looking generally parallel to said rotational axis of said drive pulley.

11. A belt tracking adjustment means as defined in claim 9 wherein said adjustment knob has a smooth generally conical surface thereon which engages said frame around said opening so that the angular disposition of said mounting stud relative to said frame is infinitely variable to facilitate said adjustment of said idler pulley axis relative to the axis of said drive pulley.

12. A belt tracking adjustment means as defined in claim 11 wherein said adjustment knob through its conical surface in engagement with the frame around said opening maintains said mounting stud in spaced relation to the internal surface of the opening to allow smooth and stepless belt tracking adjustments.

* * * * *